US008047622B2

(12) United States Patent
Lee et al.

(10) Patent No.: US 8,047,622 B2
(45) Date of Patent: Nov. 1, 2011

(54) MOUNTING STRUCTURE OF STORAGE CONTAINER FOR REFRIGERATOR

(75) Inventors: Hang-Bok Lee, Seoul (KR); Sang-Sin Kwak, Seoul (KR); Seon-Kyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/788,074

(22) Filed: May 26, 2010

(65) Prior Publication Data

US 2010/0229589 A1 Sep. 16, 2010

Related U.S. Application Data

(63) Continuation of application No. 11/265,283, filed on Nov. 3, 2005, now Pat. No. 7,806,491.

(30) Foreign Application Priority Data

Nov. 5, 2004 (KR) ..... 2004-0089728

(51) Int. Cl.
*A47B 96/04* (2006.01)

(52) U.S. Cl. ..... 312/405.1; 312/404; 312/222; 312/321.5

(58) Field of Classification Search ..... 312/405, 312/405.1, 404, 215, 222, 321.5; 292/163, 292/164, 173, 175; 62/449, 465
See application file for complete search history.

(56) References Cited

U.S. PATENT DOCUMENTS 2,012,262 A 8/1935 Forsthoefel
2,064,972 A 12/1936 Eickmeyer
2,199,881 A 5/1940 Hedlund
2,649,322 A * 8/1953 Mack ..... 292/173
2,813,737 A 11/1957 Reiter
3,146,601 A 9/1964 Gould
5,671,958 A 9/1997 Szapucki et al.
5,685,624 A * 11/1997 Lee ..... 312/405.1
6,082,130 A * 7/2000 Pastryk et al. ..... 62/344
6,148,624 A * 11/2000 Bishop et al. ..... 62/137
6,418,624 B1 7/2002 Huang
(Continued)

FOREIGN PATENT DOCUMENTS

KR 10-2006-0040293 A 5/2006

*Primary Examiner* — Janet M Wilkens
*Assistant Examiner* — Daniel Rohrhoff
(74) *Attorney, Agent, or Firm* — Birch, Stewart, Kolasch & Birch, LLP

(57) ABSTRACT

A storage container of a storage container for a refrigerator, which is configured to mount the storage container for storing articles therein to a storage container seating portion formed in a rear surface of a refrigerator door by using a mounting protrusion and locking mechanism provided on the storage container and a mounting groove and catching protrusion provided on the storage container seating portion. The mounting structure includes a storage container seating portion depressed into a portion of a rear surface of a door; a storage container seated in the storage container seating portion and formed with a space for storing articles therein; a mounting protrusion and mounting groove formed on the storage container seating portion and storage container, respectively, at positions corresponding to each other to be matched in shape with each other and used for fixing the storage container into the storage container seating portion; and a locking mechanism provided on a portion of the storage container for locking the storage container into the storage container seating portion by causing a portion of the locking mechanism to be caught to a protruding portion of the storage container seating portion.

9 Claims, 8 Drawing Sheets

U.S. PATENT DOCUMENTS 6,425,259 B2 * 7/2002 Nelson et al. ..... 62/344
6,574,984 B1 6/2003 McCrea et al.
6,905,183 B2 6/2005 Leimkuehler et al.
7,219,509 B2 5/2007 Pastryk et al.
7,469,980 B2 * 12/2008 Koo ..... 312/405.1
7,806,491 B2 * 10/2010 Lee et al. ..... 312/405.1
7,832,227 B2 * 11/2010 Wu et al. ..... 62/344
2006/0097610 A1 5/2006 Lee et al.
2006/0255596 A1 * 11/2006 Yong ..... 292/173
2010/0229589 A1 * 9/2010 Lee et al. ..... 62/344

* cited by examiner

MOUNTING STRUCTURE OF STORAGE CONTAINER FOR REFRIGERATOR

This application is a Continuation of application Ser. No. 11/265,283 filed on Nov. 3, 2005 now U.S. Pat. No. 7,806,491 the entire contents of which are hereby incorporated by reference and for which priority is claimed under 35 U.S.C. §120.

BACKGROUND OF THE INVENTION

1. Field of the Invention

The present invention relates to a storage container for a refrigerator, and more particularly, to a mounting structure of a storage container for a refrigerator which is used for mounting an ice storage container to a rear surface of the refrigerator.

2. Description of the Prior Art

In general, a refrigerator is an apparatus for storing food therein in a refrigerated or frozen state using cold air generated through the phase change of a refrigerant. Recently, as the standard of living is improved, the consumer wishes to use a large refrigerator having a variety of functions. Accordingly, the function and capacity of refrigerator becomes further increased.

FIG. 1 is a front view showing the configuration of a side-by-side refrigerator in which a dispenser, icemaker and the like are provided. Referring to this figure, two doors 10 are installed on a front surface of a main body of a refrigerator. The doors 10 are installed to be pivotal on both ends of the front surface of the refrigerator main body, respectively, such that they can selectively cover spaces partitioned from side to side in the refrigerator main body. Therefore, each of the doors 10 allows the individual storage space to be opened or closed.

The door 10 is provided with a home bar 20 and a dispenser 30 that are exposed to the outside, if desired, for the sake of user's convenience. The home bar 20 is provided on one door 10 to be exposed to the outside and is installed such that liquors or drinks can be taken out from the refrigerator without opening the door 10 in order to minimize loss of cold air which may occur when the door 10 is opened. The dispenser 30 is also provided on the other door 10 of the refrigerator to be exposed to the outside such that a user can take ice or purified water directly from the outside.

A water purification filter 32, storage tank 34, water pipe 36 and icemaker 40 are provided on an inner side of the refrigerator such that the purified water and ice can be supplied from the dispenser 30 to the outside. Some of the above components are provided on the door 10 and others are provided on the refrigerator main body. Alternatively, all of the components may be provided on the door 10. A refrigerator so configured is disclosed in U.S. Pat. No. 6,082,130 and Korean Patent No. 0432752.

A process of taking water out from the dispenser 30 will be explained. Water supplied from the outside is temporarily stored in the storage tank 34 and then purified in the water purification filter 32. Then, the purified water is taken out from a dispensing port of the dispenser 30 or flows through the water pipe.

Further, a process of taking ice out from the dispenser 30 will be explained. The purified water that passed through the storage tank 34 and water purification filter 32 is supplied to the icemaker 40 through the water pipe 36 and then frozen into ice in the icemaker 40.

The ice made in the icemaker 40 is stored in a storage container 42 positioned below the icemaker 40. This storage container 42 is formed integrally with the door 10 or it may be detachably coupled to the door through a simple fitting or coupling process, if necessary.

However, the related art refrigerator has the following problems.

That is, the ice storage container 42 should be formed integrally with the door 10 or configured such that the storage container can be detachably coupled to the door through a simple fitting or coupling process, if necessary.

In a case where the storage container 42 is formed integrally with the door 10, it is difficult to remove foreign substances from the storage container 42 or clean the interior of the storage container. Thus, there is a problem in that the sanitary conditions in the storage container become worse.

Furthermore, even though malfunction or failure occurs in the storage container 42 or the adjacent icemaker 40 or dispenser 30, the storage container 42 cannot be separated from the door for the service works. Therefore, there is another problem in that serviceability is lowered.

On the other hand, in a case where the storage container 42 is detachably coupled to the door 10 through a simple fitting or coupling process, the coupling state may be loosened or the coupling structure is deformed due to shock, vibration or the like generated by the frequent pivot motions of the door 10. Therefore, there is also a problem in that the storage container 42 cannot be properly coupled to the door 10.

SUMMARY OF THE INVENTION

Accordingly, the present invention is contemplated to solve the aforementioned problems in the prior art. An object of the present invention is to provide a mounting structure of a storage container for a refrigerator, which allows the storage container to be easily mounted to or separated from a door and a coupled state to be securely maintained. According to an aspect of the present invention for achieving the object, there is provided a mounting structure of a storage container for a refrigerator, comprising a storage container seating portion depressed into a portion of a rear surface of a door; a storage container seated in the storage container seating portion and formed with a space for storing articles therein; a mounting protrusion and mounting groove formed on the storage container seating portion and storage container, respectively, at positions corresponding to each other to be matched in shape with each other and used for fixing the storage container into the storage container seating portion; and a locking mechanism provided on a specific portion of the storage container for locking the storage container into the storage container seating portion by causing a portion of the locking mechanism to be caught to a protruding portion of the storage container seating portion.

Preferably, at least a part of a front surface of the storage container is formed of a transparent material to allow the interior of the storage container to be viewed from the outside.

More preferably, the locking mechanism comprises: a housing formed with a predetermined space therein; a catching pin received in the housing and supported by an elastic member to slightly protrude toward the outside of the housing, the catching pin including a tip end caught to the protruding portion of the storage container seating portion; and a release lever coming into contact with a portion of the catching pin and cooperating with the catching pin to allow the tip end of the catching pin to come in and out of the housing, the release lever being installed to be exposed to the outside of the storage container at a position adjacent to the housing.

More preferably, the tip end of the catching pin includes: a catching portion which selectively protrudes to the outside of housing and has a cooperating surface guided along the protruding portion of the storage container seating portion and a contact surface caught to the protruding portion; an extending portion provided at a rear end of the catching portion to pass through the elastic member; and a guide portion formed at a rear end of the extending portion to cooperate with the release lever.

More preferably, the protruding portion of the storage container seating portion is a catching protrusion including a guide surface which is upward inclined from the entrance to the interior of the storage container seating portion to guide the cooperating surface along the guide surface and a catching surface which extends from an end of the guide surface vertically toward the bottom of the storage container seating portion to be brought into contact with the contact surface.

More preferably, the release lever is mounted to the storage container in a state where the lever is supported by a restoring member and includes a guide cam having an inclined surface which is formed at a distal end thereof and along which the guide portion formed at the rear end of the catching pin is guided.

More preferably, the guide portion extends toward at least one end in a direction perpendicular to a longitudinal direction of the catching pin, and the guide cam of the release lever is formed equal in number to the guide portion.

More preferably, a direction in which the release lever is pushed is a direction in which the storage container is separated from the storage container seating portion.

According to an aspect of the present invention for achieving the objects, there is provided a mounting structure of a storage container for a refrigerator, comprising: a storage container seating portion depressed into a portion of a rear surface of a door and provided with a catching protrusion at a bottom surface thereof; a storage container seated in the storage container seating portion and formed with a space for storing articles therein, the storage container having a specific portion caught to the storage container seating portion to allow the storage container to be seated in the storage container seating portion; and a locking mechanism for locking the storage container into the storage container seating portion by causing a catching portion of a catching pin to be caught to the catching protrusion, the catching pin selectively protruding toward the outside of a housing provided at the specific portion of the storage container.

Preferably, the locking mechanism comprises: the housing formed with a predetermined space therein; the catching pin received in the housing and supported by an elastic member to slightly protrude toward the outside of the housing, the catching pin including a tip end caught to the catching protruding of the storage container seating portion; and a release lever coming into contact with a portion of the catching pin and cooperating with the catching pin to allow the tip end of the catching pin to come in and out of the housing, the release lever being installed to be exposed to the outside of the storage container at a position adjacent to the housing.

More preferably, the tip end of the catching pin includes: the catching portion which selectively protrudes to the outside of housing and has a cooperating surface guided along the protruding portion of the storage container seating portion and a contact surface caught to the protruding portion; an extending portion provided at a rear end of the catching portion to pass through the elastic member; and a guide portion formed at a rear end of the extending portion to cooperate with the release lever.

More preferably, a mounting protrusion and mounting groove are formed on the storage container seating portion and storage container, respectively, at positions corresponding to each other to be matched in shape with each other such that the storage container can be locked and seated into the storage container seating portion.

With the mounting structure of a storage container for a refrigerator according to the present invention so configured, the storage container can be easily mounted to or separated from a door through a simple operation and be more securely fixed to a container seating portion of the door. Therefore, there is an advantage in that user's convenience and safety feature can be improved.

BRIEF DESCRIPTION OF THE DRAWINGS

The above and other objects and features of the present invention will become apparent from the following description of preferred embodiments given in conjunction with the accompanying drawings, in which.

DESCRIPTION OF THE PREFERRED EMBODIMENTS

Hereinafter, a preferred embodiment of a mounting structure of a storage container for a refrigerator according to the present invention will be described in detail with reference to the accompanying drawings.

Figure 1:
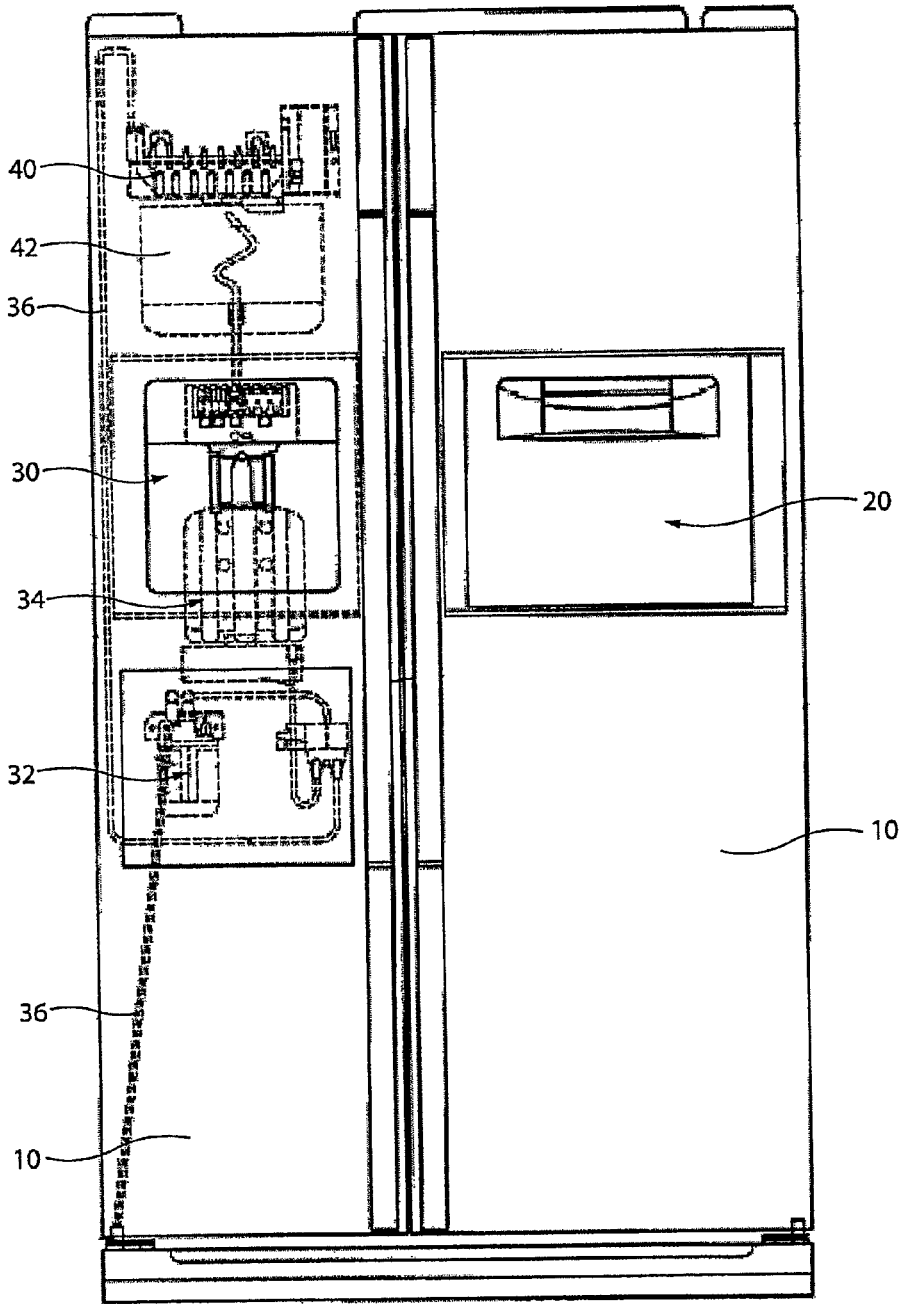
FIG. 1 Related Art
FIG. 1 is a front view showing the configuration of a general refrigerator in which a dispenser and icemaker are provided.
Figure 2:
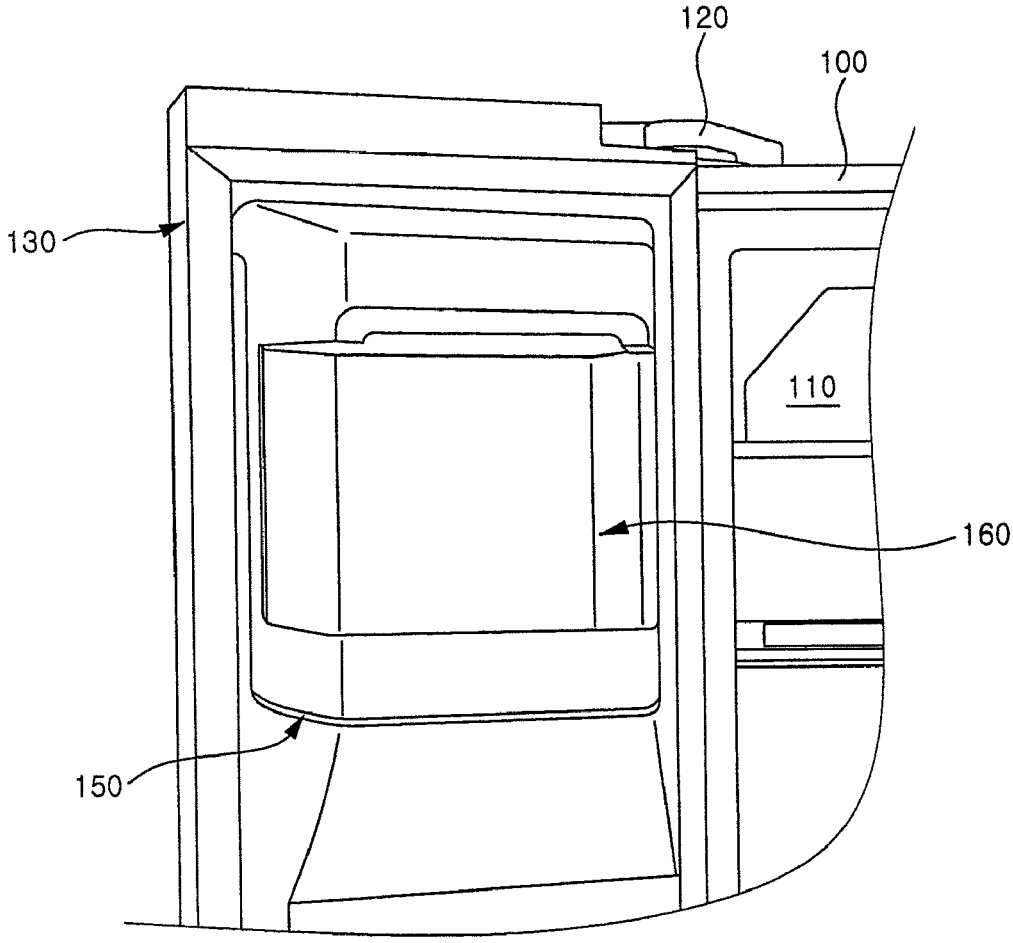
FIG. 2 is a partial perspective view showing an inner side of a door of a refrigerator to which a mounting structure of a storage container according to a preferred embodiment of the present invention is employed.
Figure 3:
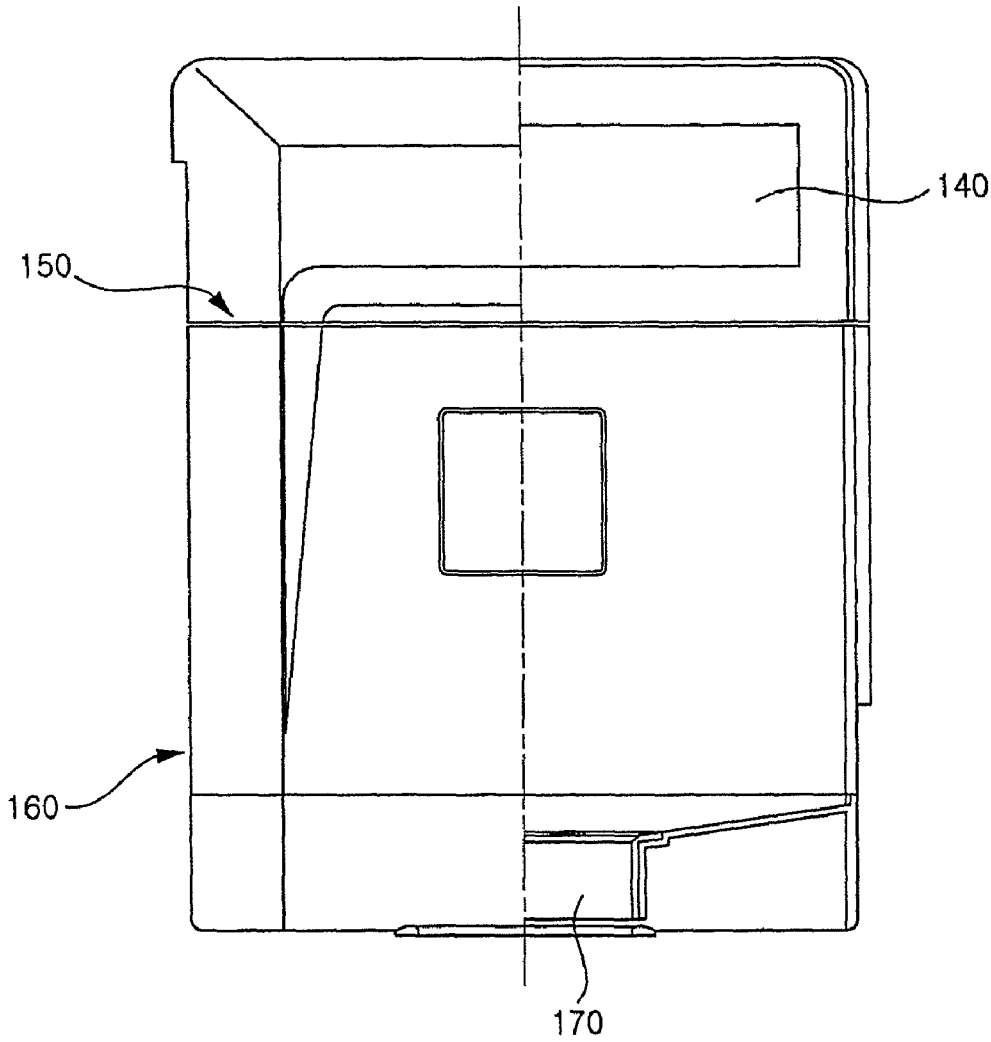
FIG. 3 is a partial sectional view showing the external appearance of the preferred embodiment of the present invention.
Figure 4:
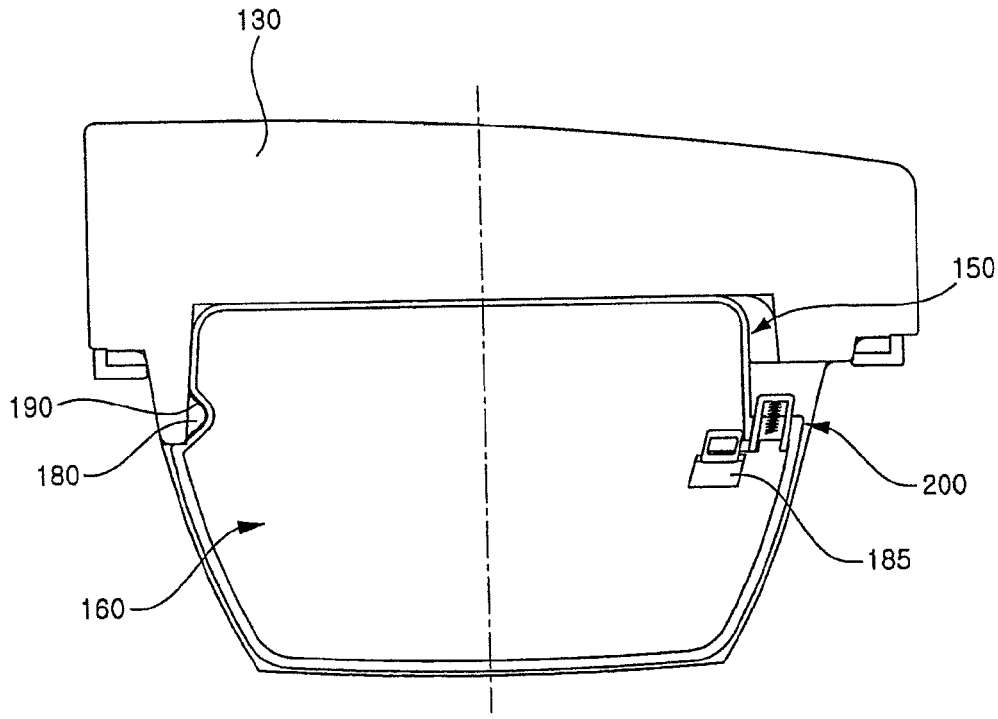
FIG. 4 is a cross-sectional view showing the configuration of the embodiment of the present invention.
Figure 5:
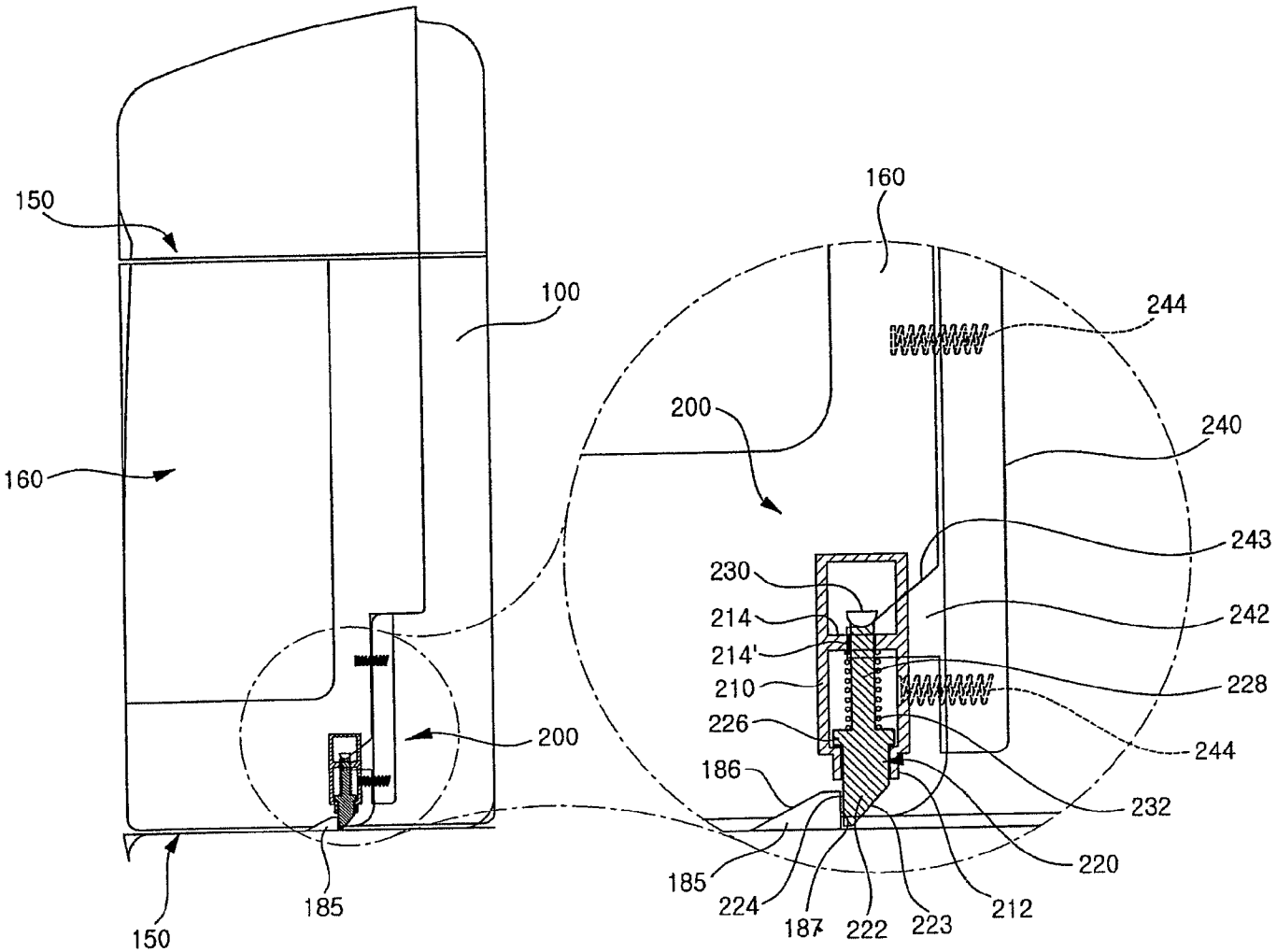
FIG. 5 is a partial side sectional view showing the configuration of major components of the embodiment of the present invention.

FIG. 2 is a partial perspective view showing an inner side of a door of a refrigerator to which the mounting structure of the storage container according to a preferred embodiment of the present invention is employed, FIG. 3 is a partial sectional view showing the external appearance of the preferred embodiment of the present invention, FIG. 4 is a cross-sectional view showing the configuration of the embodiment of the present invention, and FIG. 5 is a partial side sectional view showing the configuration of major components of the embodiment of the present invention.

Referring to these figures, doors 130 are installed on both sides on a front surface of a main body 100 of a refrigerator to selectively open and close the storage spaces 110, respectively. Each of the doors 130 is opened and closed by means of hinge assemblies 120 coupled to upper and lower ends of the refrigerator main body 130.

A plurality of baskets for storing articles necessary to be stored in a refrigerated or frozen state are provided on a rear surface of the door 130. In the case of a refrigerator mounted with a dispenser for allowing water and ice to be taken out to the outside, a water purification filter, storage tank and water pipe are provided in the interior of the door 130, while an icemaker 140 is provided on an upper portion of the door 130.

The icemaker 140 may be positioned at an upper portion of the storage space 110 of the refrigerator main body 100.

A storage container seating portion 150 to which a storage container 160 to be explained later is mounted is formed at an upper side on the rear surface of the door 130. The storage container seating portion 150 is depressed into the door 130 at a certain depth. Both upper and lower ends of the storage container seating portion 150 protrude slightly from the rear surface of the door such that the storage container 160 can be sufficiently seated in the storage container seating portion. However, the protruding portions of the storage container seating portion 150 are designed such that they do not interfere with the shelves or other parts installed in the refrigerator main body 100 when the door 130 is closed.

The storage container 160 stores ice made in the icemaker 140 and takes the shape of a box that matches in external appearance with the interior of the storage container seating portion 150. When the storage container 160 is seated in the storage container seating portion 150, a front surface and parts of side surfaces thereof are exposed as well seen from FIGS. 2 and 4. The exposed portions of the storage container are preferably formed of a transparent material such that a user can view the interior of the storage container 160. It is apparent that the storage container 160 is completely formed of a transparent material.

An ice discharge port 170 is formed at a lower side of the storage container 160. Ice stored in the storage container 160 is transferred to the dispenser located below the storage container, by its own weight, through the ice discharge port 170. To this end, the bottom of the storage container 160 is preferably inclined toward the ice discharge port 170.

As shown in FIG. 4, the storage container 160 has a roughly pentagonal cross-sectional shape in which each of corners is rounded with a predetermined curvature. Of course, the shape of the storage container 160 is not limited thereto, but it is most preferable in consideration of the relationship between the storage container and other components of the refrigerator main body 100.

Although it is not illustrated in the accompanying drawings, an upper side of the storage container 160 should be formed open upward in a case where the icemaker 140 for supplying ice to the storage container 160 is provided at the upper portion of the refrigerator main body 110 corresponding to an upper side of storage container 160. At this time, the icemaker 140 should be designed such that it can be positioned at an open portion of the storage container when the door 130 is closed.

Now, the constitution of fixedly mounting the storage container 160 to the storage container seating portion 150 will be explained with reference to FIGS. 4 and 5. A mounting protrusion 180 is formed on one of inner surfaces of the storage container seating portion 150. A mounting groove 190 is formed on an outer surface of the storage container 160 such that the mounting protrusion 180 can be seated in the mounting groove. Of course, the mounting protrusion 180 and the mounting groove 190 may be formed conversely. That is, the mounting protrusion 180 is formed on the storage container 160 and the mounting groove 190 is formed on the storage container seating portion 150.

The mounting protrusion 180 is matched in shape with the mounting groove 190 and may have its tip end taking the shape of a round cone. Of course, the mounting protrusion 180 may be formed vertically on the inner side surface of the storage container seating portion 150 in the form of a triangular prism.

The mounting protrusion 180 and the mounting groove 190 are matched in shape with each other to guide and slightly fix the storage container 160 into the storage container seating portion 150. For the smooth mounting to and separation from each other, edge portions of the mounting protrusion and mounting groove are rounded with a predetermined curvature.

An outer surface of the storage container 160, i.e. at least a part of a surface opposite to the surface of the storage container on which the mounting protrusion 180 or mounting groove 190 is provided, is stepped inward. A locking mechanism 200 is installed on the stepped portion of the storage container 160. A catching protrusion 185 is also formed on the storage container seating portion 150 at a position corresponding to the locking mechanism 200. A portion of the locking mechanism 200 is caught to the catching protrusion 185 such that the storage container 160 can be completely locked and fixed in the storage container seating portion 150. The catching protrusion 185 is formed with a guide surface 186, which is inclined to be gradually raised as viewed from the rear surface of the door 130, and a catching surface 187 which extends vertically toward the bottom of the storage container seating portion 150 at a position where the guide surface 186 is terminated. Actually, a portion of the locking mechanism 200 is selectively caught in the catching surface 187.

Now, the constitution of the locking mechanism 200 will be described. A housing 210 is provided at a portion of the storage container 160. The housing 210 has a predetermined internal space and an inlet 212 with a relatively smaller diameter. A support 214 is formed at a portion in the housing 210. The support 214 is formed around an inner surface of the housing 210 with a predetermined height. A through-hole 214' is formed in the support 214.

A catching pin 220 is formed within the housing 210. The catching pin 220 is configured such that its tip end can be selectively caught to the catching protrusion 185 while it reciprocates in and out of the housing 210.

The catching pin 220 is formed with a catching portion 222 at the tip end thereof. The catching portion 222 has a cooperating surface 223 that is guided along the guide surface 186 of the catching protrusion 185 to allow the catching pin 220 to be ascend or descend. A surface opposite to the cooperating surface 223 becomes a contact surface 224. The contact surface 224 is brought into contact with the catching surface 187 of the catching protrusion 185 such that the catching pin 220 can be kept at a state where it is caught to the catching protrusion 185. A supporting flange 226 is formed at a rear end of the catching portion 222. The supporting flange 226 is formed around an outer circumferential surface of the catching portion 222 with a predetermined height such that it can be caught to an inner side of the inlet 212 and prevent the catching pin 220 from being escaped out of the housing 210. An end of an elastic member 232 to be explained later is also seated on the supporting flange 226.

An extending portion 228 extends from the rear end of the catching portion 222. The extending portion 228 has a relatively smaller diameter and a predetermined length. The extending portion 228 penetrates through the through-hole 214' of the support 214.

A guide portion 230 is formed at a rear end of the extending portion 228. The guide portion 230 extends in a direction perpendicular to a direction in which the extending portion 228 extends. The guide portion 230 penetrates through a side of the housing 210 and protrudes to the outside. In the figure of this embodiment, the guide portion 230 extends toward only one direction perpendicular to the extending direction of the extending portion 228. However, the guide portion 230 may extend toward opposite directions perpendicular to the extending direction of the extending portion 228. A slot (not shown) should be formed in the housing 210 such that the guide portion 230 can pass through the housing 210.

The catching pin 220 is supported by the elastic member 232 installed in the housing 210. The elastic member 232 allows the catching portion 222 of the catching pin 220 to come out of the housing 210. One end of the elastic member 232 is supported on the supporting flange 226, while the other end of the elastic member is supported on the support 214.

A release lever 240 is installed on the storage container 160 such that it is exposed to the outside. That is, the release lever is installed at the stepped portion of the storage container 160 in an exposed state. The release lever 240 is provided with a guide cam 242 at one side thereof. The guide cam 242 cooperates with the guide portion 230 of the catching pin 220. The guide cam 242 extends in a direction in which the release lever 240 is operated. The guide cam 242 is formed with an inclined surface 243 along which the guide portion 230 is guided. When a user pushes the release lever 240, the guide portion 230 is guided along the inclined surface 243 of the guide cam 242 and the catching pin 220 is moved accordingly.

Since the release lever 240 is supported by a restoring member 244, it is restored to an original position when a force applied by a user is removed. The one end of the restoring member 244 is supported on the storage container 160, while the other end of the restoring member 244 is supported on the release lever 240. As well shown in FIG. 5, the release lever 240 generally has a "["-shaped cross-section and is configured such that both tip ends thereof protruding perpendicular to its longitudinal direction can be inserted in the stepped portion of the storage container 160.

The guide cam 242 of the release lever 240 cooperates with the guide portion 230 of the catching pin 220. If the guide portion 230 protrudes toward only one side of the housing 210 as illustrated in this embodiment, only one guide cam 242 is needed. However, if the guide portion 230 protrudes toward opposite sides of the housing 210, two guide cams 242 are needed.

Hereinafter, the operation of the mounting structure of the storage container according to the present invention so configured will be described.

First, a process of separating the storage container 160 from the storage container seating portion 150 is explained. A user pushes the release lever 240 installed on the storage container 160. A direction in which the release lever 240 is pushed is a direction in which the storage container 160 is separated from the storage container seating portion 150.

Figure 6:
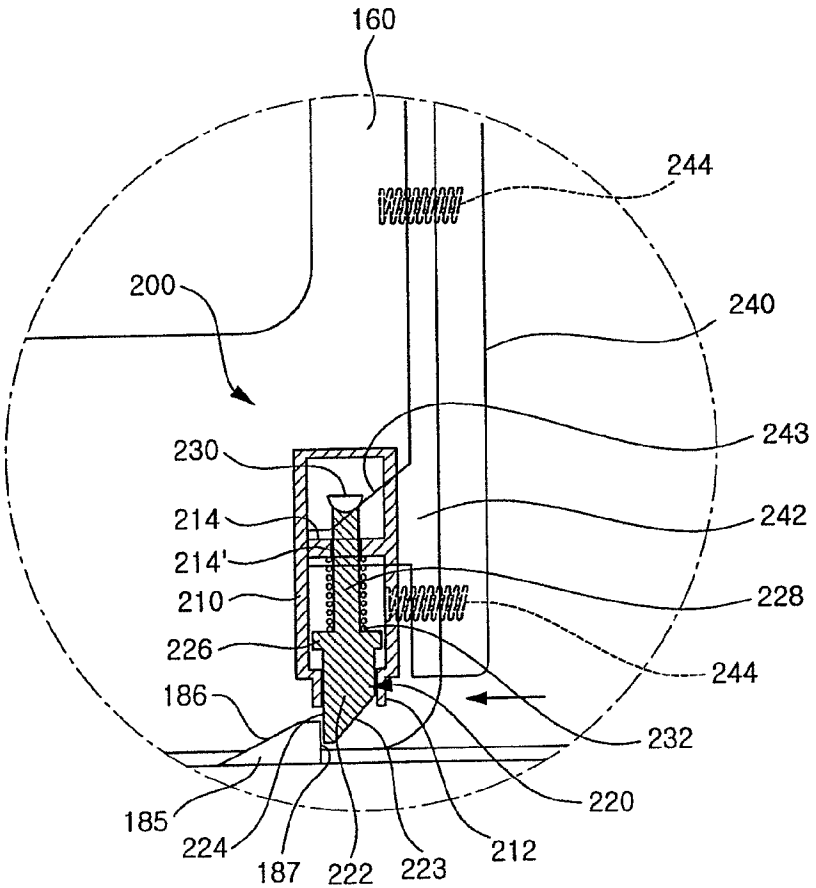
FIGS. 6 to 8 are views showing the operation of separating and mounting the storage container from and to a seating portion for the storage container according to the embodiment of the present invention.

When the release lever 240 is pushed, the release lever 240 causes the restoring member 244 to be elastically deformed while moving in a direction of an arrow, as shown in FIG. 6. As the release lever 240 is moved, the guide cam 242 is also moved. Thus, the guide portion 230 is moved upward along the inclined surface 243.

As the guide portion 230 is moved along the inclined surface 243, the catching pin 220 is gradually raised. That is, the catching pin 220 is moved upward against an elastic force of the elastic member 232, and thus, the catching portion 222 is received into the housing 210.

Therefore, the contact surface 224 of the catching portion 222 is no longer brought into contact with the catching surface 187 of the catching protrusion 185. Such a state is shown in FIG. 6. In such a state, the storage container 160 is seated in the storage container seating portion 150 by means of only the connection between the mounting protrusion 180 and the mounting groove 190.

When a user applies a certain force to the storage container 160 in a state of FIG. 6 in a direction in which the release lever 240 is pushed, the storage container 160 can be separated from the storage container seating portion 150. Therefore, if a user wishes to separate the storage container 160 from the storage container seating portion 150, he/she can merely push the release lever 240 in a direction of an arrow A and then keep applying a predetermined force to storage container 160 in the same direction.

Figure 7:
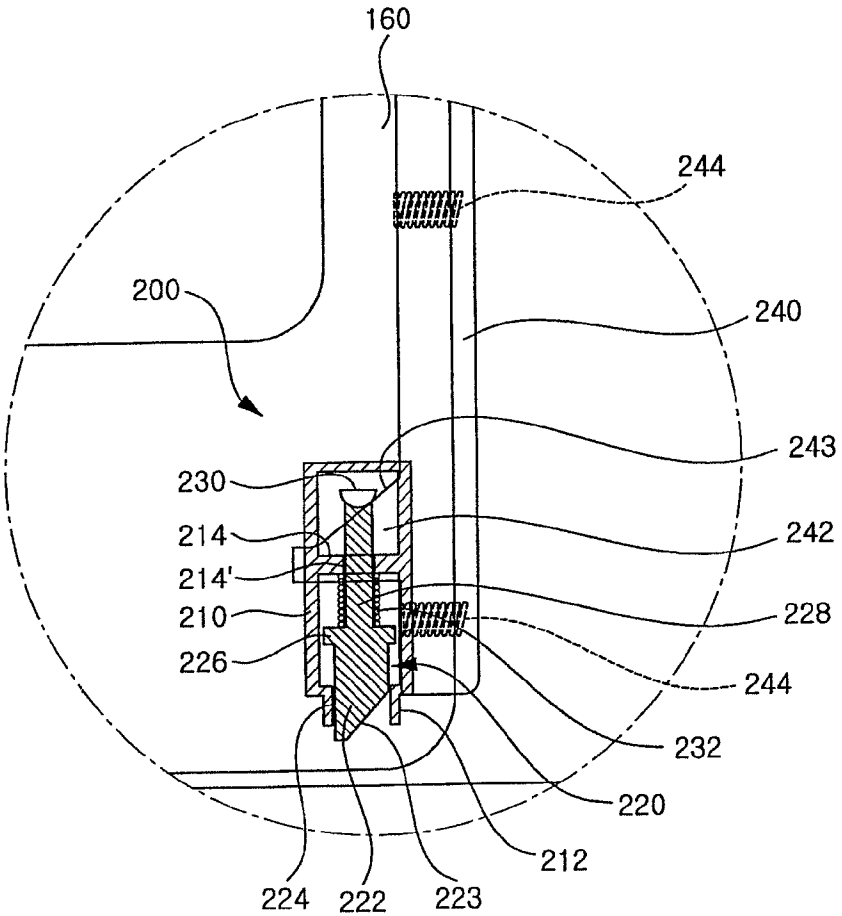

If a user has separated the storage container 160 from the storage container seating portion 150 and then remove the predetermined force applied to the release lever 240, the release lever 240 is restored to its original position by means of the restoring member 244 and the catching portion 222 of the catching pin 220 also comes out of the housing 210 through the inlet 212. Such a state is shown in FIG. 7.

Next, a process of mounting the storage container 160 into the storage container seating portion 150 is explained. First, the storage container 160 is pushed into the storage container seating portion 150 such that the mounting protrusion 180 of the storage container seating portion 150 can be inserted into the mounting groove 190 of the storage container 160. In particular, it is preferable to push an entire surface of the storage container 160 on which the locking mechanism 200 is provided.

Figure 8:
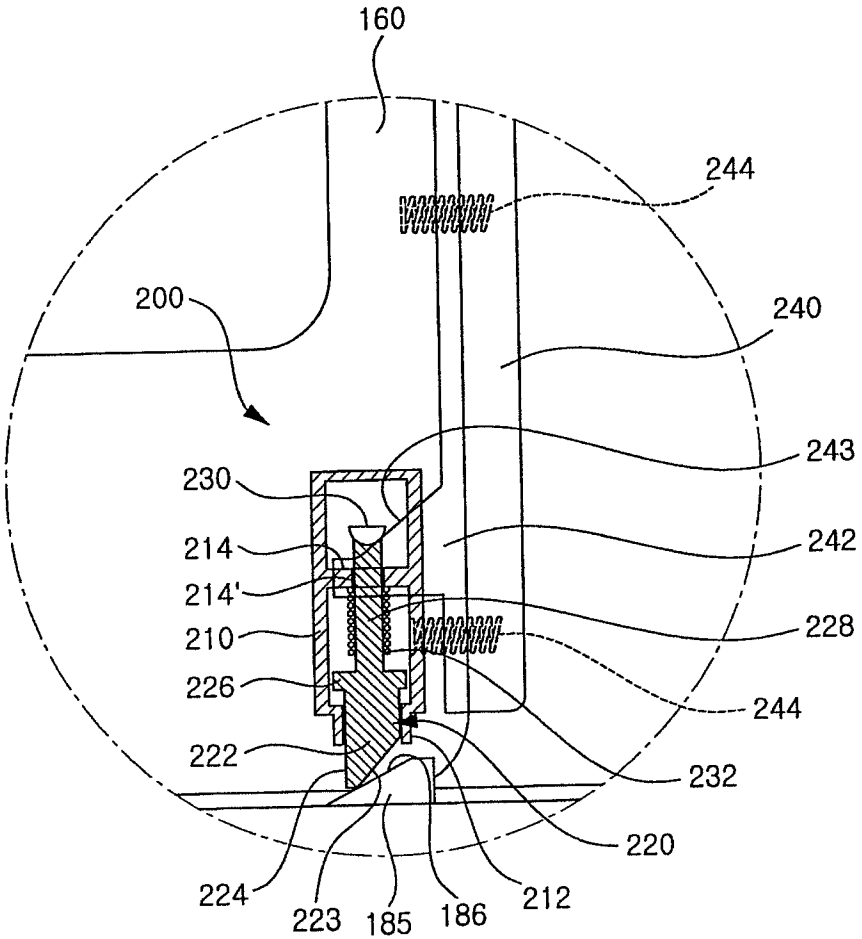

If the storage container 160 is pushed into the storage container seating portion 150, the cooperating surface 223 of the catching portion 222 of the catching pin 220, which has protruded through the inlet 212 of the housing 210, is guided along the guide surface 186 of the catching protrusion 185. As the cooperating surface 223 is guided along the guide surface 186 of the catching protrusion 185, the catching pin 220 begins to be received in the housing 210, as shown in FIG. 8.

After the cooperating surface 223 formed on the catching portion 222 of the catching pin 220 passed over the guide surface 186 of the catching protrusion 185, the catching pin 220 protrudes again to the outside of the housing 210 by means of the elastic force of the elastic member 232. Therefore, it is in a state where the contact surface 224 of the catching portion 222 is brought into contact with and caught to the catching surface 187 of the catching protrusion 185. Such a state is shown in FIG. 5.

The scope of the present invention is not limited to the aforementioned embodiment. It will be apparent to those skilled in the art that various modifications may be made within the scope of this basic technical spirit of the present invention.

In the mounting structure of the storage container for a refrigerator according to the present invention as described above, the storage container can be seated in the storage container seating portion when the mounting protrusion is coupled to the mounting groove, and the storage container can be locked in the storage container seating portion when the locking mechanism is caught to the catching protrusion. Therefore, since the storage container is firmly locked in the storage container seating portion, the former is not easily separated from the latter due to the shock, vibration or the like generated by the pivot motion of the door.

Further, if the release button of the locking mechanism is pushed, the storage container can be easily separated from the storage container seating portion. Therefore, a user can separate the storage container from the storage container seating portion through only a simple operation. Accordingly, an advantage in that use convenience as well as serviceability is improved can be expected.

Furthermore, since the cleaning work is easily performed and the serviceability is improved, cleaner state and superior operating state can be maintained. Therefore, the storage container can be managed in a more sanitary state.

What is claimed is:

1. A refrigerator, comprising:

a main body having a storage chamber;

a door hinged to the main body, the door having an ice dispenser;

a storage container seating portion recessed into a portion of a rear surface of the door, the storage container seating portion including a protruding portion;

an ice storage container mounted on the storage container seating portion, the ice storage container fixed to the storage container seating portion by the protruding portion;

an ice maker provided on an upper portion of the door;

a release lever to be gripped by a hand of a user; and a catching pin for locking the ice storage container to the storage container seating portion, the catching pin configured to be selectively engaged to the protruding portion by an operation of the release lever, wherein the ice storage container has an ice discharge opening in the bottom portion thereof and is substantially horizontally detached from the storage container seating portion and is substantially moved straight, and when pulling the ice storage container out of the door, the release lever moves the catching pin to be disengaged from the protruding portion, and wherein the release lever is pulled in substantially the same direction as the direction that the ice storage container moves, when the ice storage container is separated from the door.

2. The refrigerator according to claim 1, further comprising:

a mounting protrusion protruded from the storage container seating portion; and a mounting groove formed on the ice storage container.

3. The refrigerator according to claim 1, wherein the bottom surface of the ice storage container moves along a substantially horizontal surface which extends from the bottom surface of the storage container seating portion.

4. The refrigerator according to claim 1, further comprising a restoring member that allows the release lever to return to the initial position when the pressure to the release lever is removed.

5. The refrigerator according to claim 1, wherein a portion of the ice storage container is transparent to permit viewing of the space for storing ice within the ice storage container.

6. The refrigerator according to claim 1, wherein the ice storage container has a roughly pentagonal cross sectional shape.

7. The refrigerator according to claim 1, further comprising an elastic member which is elastically deformed by the operation of the release lever, wherein when pulling the release lever, the elastic member is deformed such that the catching pin is disengaged from the protruding portion.

8. The refrigerator according to claim 1, wherein at least a part of a side surface of the ice storage container is stepped inward to accommodate the release lever.

9. The refrigerator according to claim 8, wherein a gap is defined between the stepped portion and the storage container seating portion to allow the hand of a user to access the release lever.

* * * * *